US008925844B2

(12) United States Patent
Keyssner

(10) Patent No.: US 8,925,844 B2
(45) Date of Patent: Jan. 6, 2015

(54) ROLLER MILL

(75) Inventor: Michael Keyssner, Duesseldorf (DE)

(73) Assignee: Loesche GmbH, Duesseldorf (DE)

( * ) Notice: Subject to any disclaimer, the term of this patent is extended or adjusted under 35 U.S.C. 154(b) by 36 days.

(21) Appl. No.: 13/981,716

(22) PCT Filed: Mar. 15, 2012

(86) PCT No.: PCT/EP2012/001162
§ 371 (c)(1),
(2), (4) Date: Jul. 25, 2013

(87) PCT Pub. No.: WO2012/126590
PCT Pub. Date: Sep. 27, 2012

(65) Prior Publication Data

US 2013/0313348 A1 Nov. 28, 2013

(30) Foreign Application Priority Data

Mar. 21, 2011 (DE) ..... 10 2011 014 592

(51) Int. Cl.

| | |
|---|---|
| ***B02C 19/00*** | (2006.01) |
| ***B02C 15/04*** | (2006.01) |
| ***B02C 15/00*** | (2006.01) |
| ***B02C 23/02*** | (2006.01) |
| ***B02C 23/24*** | (2006.01) |
| ***B02C 23/30*** | (2006.01) |
| ***B02C 23/32*** | (2006.01) |

(52) U.S. Cl.
CPC ..... *B02C 15/04* (2013.01); *B02C 15/007* (2013.01); *B02C 23/02* (2013.01); *B02C 23/24* (2013.01); *B02C 23/30* (2013.01); *B02C 23/32* (2013.01)
USPC ..... 241/117; 241/119

(58) Field of Classification Search
USPC ..... 241/117–121
See application file for complete search history.

(56) References Cited

U.S. PATENT DOCUMENTS 2,100,734 A * 11/1937 Crites ..... 241/53
2,112,359 A * 3/1938 Crites ..... 241/53

(Continued)

FOREIGN PATENT DOCUMENTS

DE 1938772 2/1971
DE 3134601 10/1985

(Continued)

OTHER PUBLICATIONS

International Search Report relating to PCT/EP2012/001162 filed Mar. 15, 2012.

(Continued)

*Primary Examiner* — Faye Francis
(74) *Attorney, Agent, or Firm* — Dinsmore & Shohl LLP

(57) ABSTRACT

The invention relates to a roller mill, in particular a coal mill, with a feed system, having an integrated screw feeder. The screw feeder is arranged virtually horizontally in the region of a grit cone and comprises a screw shaft guided through the roller mill and the longitudinal axis thereof, which screw shaft is arranged on both sides respectively outside of the roller mill and at one end with a drive means and at the other end in a bearing outside of the roller mill. The feed material is fed with the screw conveyer outside of the roller mill and forcibly conveyed therein to a tray side rejection opening above a cone opening of the grit cone and drops together with the coarse grain rejected in the classifier centrally onto the grinding pan. An even distribution of the feed material and improved smooth running of the roller mill and energy saving are achieved and also soiling of the screw shaft is avoided.

10 Claims, 1 Drawing Sheet

(56) References Cited

U.S. PATENT DOCUMENTS

| | | | | |
|---|---|---|---|---|
| 3,038,671 | A * | 6/1962 | Marchfelder | 241/120 |
| 4,432,500 | A | 2/1984 | Brundiek et al. | |
| 4,597,537 | A | 7/1986 | Misaka et al. | |
| 4,606,506 | A | 8/1986 | Okada et al. | |
| 4,927,086 | A * | 5/1990 | Henne et al. | 241/80 |
| 5,381,968 | A * | 1/1995 | Lohnherr et al. | 241/19 |
| 5,531,388 | A * | 7/1996 | Brundiek et al. | 241/48 |
| 5,580,002 | A * | 12/1996 | Ward et al. | 241/17 |
| 6,827,221 | B1 | 12/2004 | Brundiek et al. | |
| 7,226,010 | B2 * | 6/2007 | Zhang et al. | 241/121 |
| 2005/0145732 | A1 * | 7/2005 | Oder et al. | 241/119 |

FOREIGN PATENT DOCUMENTS

| | | | |
|---|---|---|---|
| DE | 19528338 | | 10/1996 |
| DE | 10224009 | | 1/2004 |
| EP | 0294609 | A2 | 12/1988 |
| JP | 2000237614 | | 9/2000 |
| JP | 2000312832 | A | 11/2000 |

OTHER PUBLICATIONS

International Preliminary Report on Patentability relating to PCT/EP2012/001162 filed Mar. 15, 2012, dated Sep. 24, 2013.

* cited by examiner

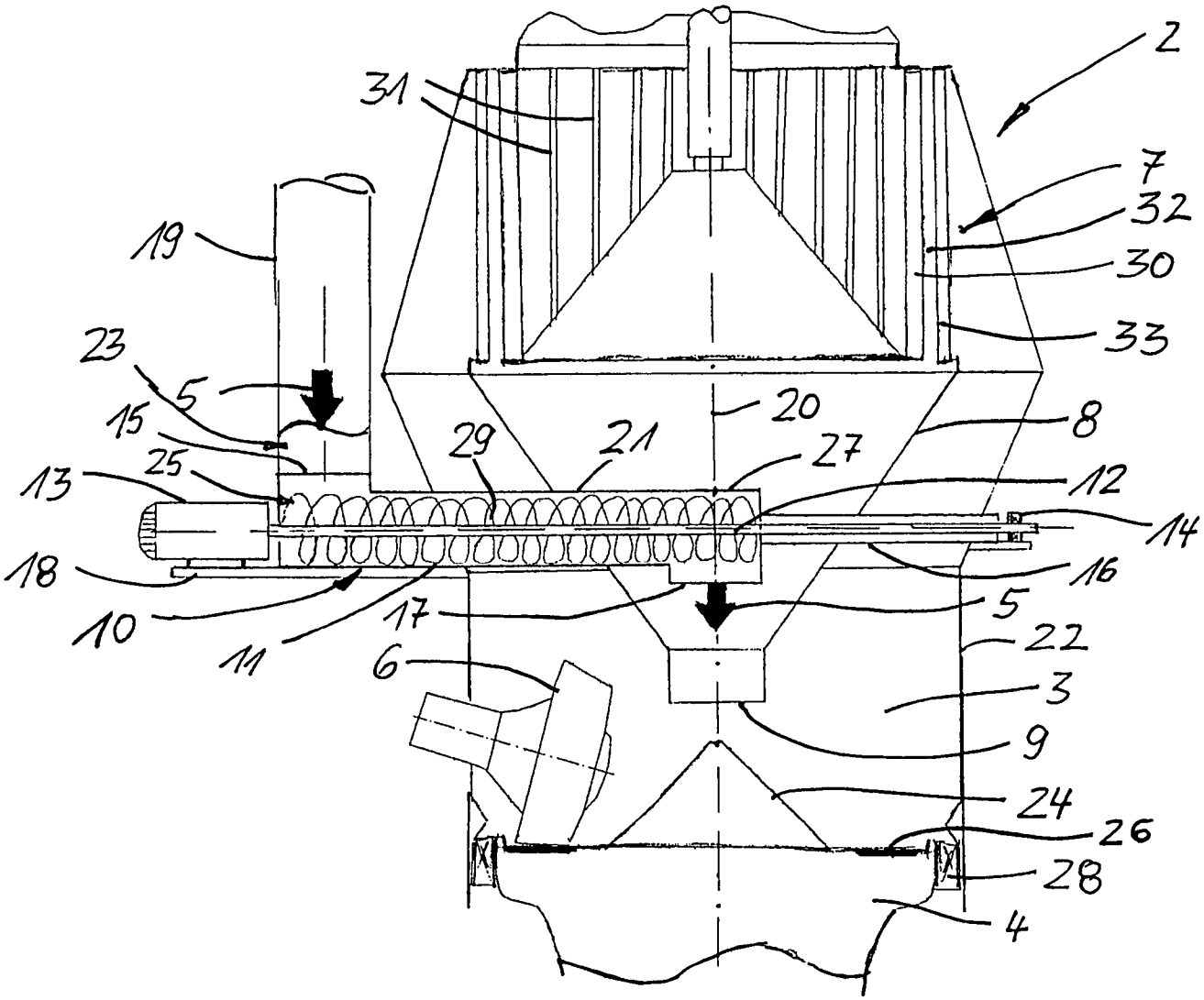
2
7
32
30
33
8
12
14
16
5
22
3
9
24
26
28
4
20
27
21
29
31
17
6
19
23
15
25
13
18
10
11

ROLLER MILL

The invention relates to a roller mill according to the preamble to claim 1.

The invention is suitable in particular for roller mills which are provided for grinding raw coal.

Roller mills which comprise a grinding pan or a grinding plate with a grinding track and with resiliently impacted grinding rollers which roll on the grinding track or on a grinding bed formed thereon by supplied feed material are used to grind the most varied materials (DE 102 24 009 B4, DE 31 003 41 A1 and DE 31 34 601 C2).

The feed material which is ground in a grinding gap between the grinding rollers and the grinding track can be fed to the grinding chamber and the rotating grinding pan laterally or centrally.

In case of air swept roller mills the ground grinding material is fed in an ascending gas flow, for example an air flow, which passes via an annular set of vanes around the periphery of the grinding pan into the grinding chamber, to a classifier arranged above the grinding chamber. Fine material is expelled in the gas flow while the coarse material particles are rejected in the classifier and fed back via a grit cone with a bottom-side cone opening to the central region of the grinding pan and pass due to the centrifugal force effect under the grinding rollers for renewed grinding.

A central supply or feed of material to be ground into vertical roller mills takes place perpendicularly from above into the centre of the grinding pan through a feed drop tube which is guided centrally through the classifier (U.S. Pat. No. 4,606,506, DE 195 28 338 C1). In the case of this supply, it is generally possible to extensively prevent, even with very moist and sticky feed material, for example raw coal, a blocking of the feed tube through deposit build-up. A disadvantage, however, is that a classifier rotor with a hollow shaft for receiving the feed drop tube must be used. Such a classifier rotor is considerably more cost-intensive in comparison with a conventional classifier drive construction. For relatively large classifiers with a fall tube diameter >1 m, in addition an economic realisation is not possible due to the required high peripheral speeds with outer toothed axial roller bearings. In addition the height of the feed point for the feed material above the classifier is disadvantageous due to the longer conveyance paths to be executed at the necessary height and the associated investment and energy requirement.

In particular in case of large mill and classifier units the feed of the feed material takes place via greatly inclined feed chutes which are arranged laterally at the classifier and do not extend into the centre of the roller mill or the grinding chamber (EP 1 239 966 B1, U.S. Pat. No. 4,597,537). In such feed assemblies the risk of deposit build-up in the feed chute is produced. The great inclination of the feed chute simultaneously prevents a discharge parabola for the raw coal into the centre of the grinding pan. For this purpose the classifier and the lateral feed chute would have to be positioned considerably higher. The feed material, for example raw coal, drops out of the feed chute laterally onto the grinding pan and does not pass centrally onto a dispersion plate or a distribution body formed as a truncated cone in the centre of the grinding pan and cannot therefore be fed evenly to all the grinding rollers for grinding down. Disadvantageous consequences are uneven grinding roller load and reduced smooth running of the roller mill and a lower energy efficiency of the grinding process. Incomplete supply of the raw coal to the grinding rollers and for grinding can also lead to deposits of coal dust and to a risk of fire.

DE 19 38 772 C3 discloses a roller mill with an integrated wind classifier and with a material feed channel which is greatly inclined and goes through the mill and funnel wall of the classifier. The material feed channel ends on the outer middle side in the funnel outlet and the feed material passes with the coarse grain rejected in the classifier via a central feed nozzle to a distribution cone in the centre of the grinding track. The material supply channel is intended to be formed for a complete and even material supply as pneumatic or vibration conveying groove.

In case of smaller coal mills a lateral feed assembly by means of a horizontal tubular screw conveyer on the mill upper part is usual. If the screw pipe ends on the mill housing the feed material is supplied outside the middle of the grinding pan. The raw coal must be caught by the upwardly flowing gas flow and distributed in the grinding chamber before grinding can take place in the grinding gap between the grinding rollers and the grinding pan or grinding track. The outlet speed of the gas flow out of the annular vane assembly surrounding the grinding pan must be set correspondingly high in order that the supplied, large-particle raw coal cannot drop, under the influence of gravitational force, contrary to this gas flow through the annular vane assembly into a reject outlet below the grinding pan without being subjected to the grinding process. Both the uneven distribution of the supplied raw coal in the grinding chamber and also the increased gas speed to avoid the material fall-out via the vane assembly additionally require increased energy resources.

EP 0 294 609 A2 discloses a roller mill with two grinding rollers which is provided for a relatively small throughput and for example as a laboratory mill. The desired simple and cost-effective construction relates to formation and arrangement of the roller carrier and the bearing thereof. The roller carrier crosses through the mill housing above the grinding plate diametrically and has a middle part with a central passage opening for feed material which is fed via a feed nozzle arranged centrally in a cover of the roller mill. An alternative roller mill is provided with a wind classifier and a grit cone. A tubular screw conveyor arranged horizontally, shown in only one drawing, ends in a region of the cone wall so that supplied feed material can pass along the cone wall to a cone opening and centrally onto the grinding plate.

JP 2000 237 614 A discloses an air swept roller mill with an additional classifier air flow for varying the particle size distribution which is fed tangentially above the grinding rollers but below the classification chamber. The removal of coarse material rejected in the classifier also serves for variable grain size distribution with the aid of a screw conveyer which extends directly below the grit cone opening. The feed material to be ground passes via a screw conveyer which ends in a vertical discharge tube of the grit cone or in the region between the grinding rollers and the grit cone centrally onto the grinding pan.

JP 2000 312 832 A discloses a vertical mill with a classifier rotor but without a grit cone. The feed material passes via a feed line and a horizontal screw conveyer which ends between two grinding rollers into the grinding chamber. The screw conveyer is mounted laterally on the mill housing and does not extend with its opening into the mill centre.

Depending upon construction the screw conveyers mounted on one side on the mill housing do not guarantee in any case uninterrupted supply of the feed material. An additional assembly in the grit cone wall is relatively expensive and not suitable for ensuring a complete, even and continuous material feed in any case.

It is an object of the invention to create a roller mill, in particular a coal mill, which guarantees a continuous, even and cost-effective feed/supply of the feed material and an interference-free, efficient grinding process.

According to the invention the object is achieved through the features of claim 1. Useful and advantageous embodiments are contained in the sub-claims and in the description of the FIGURE.

The invention is based on a roller mill, in particular an air swept roller mill for grinding raw coal, with a feed system which guarantees a feed of the raw coal into the centre of the roller mill, in particular into the centre of the grinding pan, which is provided here advantageously with a definitely formed distribution region. The feed material is discharged in the centre of the grit cone which is arranged above the grinding chamber and below a classifier so that the feed material together with the coarse material rejected by the classifier rotor reaches the centre of the grinding pan and is distributed evenly to all grinding rollers.

On the basis of a feed system with a screw conveyer which is integrated into the grit cone and is designed and arranged in such a way that the feed material is conveyed both into the roller mill and centrally fed to the grinding pan, it is provided according to the invention in a constructively particularly simple and efficient arrangement in such a way that the screw feeder is provided with a screw shaft which is guided through the roller mill and the grit cone and is arranged with end regions outside of the roller mill.

It is useful to form the screw feeder as a tubular screw conveyer and to guide it essentially horizontally through the roller mill and the grit cone whereby according to the invention the screw shaft cuts the longitudinal axis of the roller mill.

According to the invention the screw shaft of the screw feed is connected at one end to a drive means and at the other end in a bearing. According to the invention the drive means and the bearing of the screw shaft are arranged outside of the roller mill.

It is advantageous that the drive means and the bearing of the screw shaft can be arranged on a supporting construction on the mill housing.

The bearing of the screw shaft outside of the roller mill or the grinding/classification chamber extensively prevents soiling by coal dust.

Sealing between the rotating screw shaft and the mill housing can advantageously take place mechanically or by means of barrier gas.

The screw shaft is usefully provided outside of a conveyor tray of the screw feeder with a protective pipe which extends from a grinding chamber side end region of the screw feeder as far as close to the bearing of the screw shaft outside of the roller mill.

The drive means, for example an engine with gearbox, can be designed with constant or controllable speed, for example by means of frequency inverter.

A mill outer side end region of the screw feeder is provided outside of the roller mill with the laterally arranged drive means while a grinding chamber side end region is arranged in the grit cone of the roller mill.

In order to convey feed material into the roller mill the mill outer side end region of the screw feeder is provided with a receiving opening, via which the feed material passes into the screw feeder and with the aid of the screw drive in a forced conveyance as far as into the centre of the roller mill which is determined by the longitudinal axis of the roller mill.

The grinding chamber side end region of the screw feeder comprises an ejection opening which is formed and dimensioned coaxially with the longitudinal axis of the roller mill for the central supply of the feed material. After the compulsory conveyance of the feed material transported in the tubular tray or conveyor tray of the screw feeder this material can be supplied very exactly and reliably through the centrally arranged, definitely measured, tray side ejection opening perpendicularly downwards onto the grinding pan and the central distribution region and evenly fed to the grinding rollers.

Such a supply and simultaneous distribution of the feed material, preferably together with the coarse grain rejected in the classifier, facilitates an energetically extraordinarily advantageous grinding process. The even distribution of the feed material to be ground additionally improves the smooth running of the roller mill and allows better adjustment of the adjustment parameters for the grinding.

The screw drive, the conveyor tray and a cover or the tubular screw conveyer extend from the mill outer side end region as far as the grinding chamber side end region while the screw shaft reaches from the outer side drive means which is arranged in particular close to the receiving opening as far as the bearing outside of the roller mill at the opposing end region.

It is advantageous if the screw feeder is connected via its receiving opening in the mill outer side end region with a feed channel for the feed material. This feed channel can usefully be arranged essentially perpendicularly and comprise a cell wheel sluice at the upper end which serves as air closure.

The feed channel of the feed system can be formed in a simple construction as a closed pipeline. The feed material can then drop out of the cell wheel sluice via the closed supply channel and via the receiving opening into the screw conveyer or into the conveyor tray in order to then be transported using the screw gear as far as the tray side ejection opening and fed centrally to the grinding pan perpendicularly dropping down thereto.

Advantages of the roller mill with a screw feeder according to the invention consist, besides a continuous, even and interruption-free supply of the feed material into the centre of the grinding pan and an even distribution of the feed material, together with the coarse grain rejected in the classifier to the grinding pan and under the grinding rollers in an energy saving process for the grinding process. Energy savings up to 5% in relation to the feed arrangements used thus far are possible. In addition an interruption-free and reliable continuous material feed is guaranteed.

The invention is explained further below using a drawing. The single drawing shows a roller mill according to the invention in a highly schematised way and in a cut-out.

The roller mill 2 comprises a grinding pan 4 which rotates about a longitudinal axis 20. The grinding pan 4 is provided with a grinding track 26, on which a grinding bed is formed from feed material to be ground (not shown). Grinding rollers 6 arranged in a stationary manner and force impacted with the aid of a suspension system (not shown) roll on this grinding bed and grind the feed material 5 which is fed with the aid of a feed system.

Merely one grinding roller 6 is schematically shown in the drawing. In principle, two, three, four or more grinding rollers can be arranged.

The ground grinding material (not shown) is fed in an ascending gas flow (not shown) which is fed via an annular vane assembly 28 on the periphery of the grinding pan 4 to the grinding chamber 3, to a classifier 7, which is arranged above the grinding chamber 3 and is integrated in this embodiment into the roller mill 2, fed for classification.

The classifier 7 is provided with a rotor 30 rotating about the longitudinal axis 20 which comprises classifier bars 31. A guide vane circle 33 is arranged concentrically around the classifier rotor 30 with the formation of a classification chamber 32.

Sufficiently ground fine material (not shown) leaves the classifier 7 in the gas flow via a fine material outlet (not shown) while coarse grain (not shown) is rejected by the classifier 7 and drops into a grit cone 8 below the classifier 7. The grit cone 8 comprises on the bottom side a central cone opening 9 which facilitates a central supply of the coarse grain to the grinding pan 4 or to a central distribution region 24 of the grinding pan 4 and an even supply to the grinding rollers 6.

In the present exemplary embodiment the central distribution region 24 is formed as a truncated cone. An even distribution of the coarse grain and the feed material 5 supplied using the feed system is guaranteed insofar as the feed material 5 and the coarse grain are evenly carried away via the conical distribution region 24 or displacement body and reach the grinding pan 4 under the effect of centrifugal force in the direction of the grinding track 26 and get under the grinding rollers 6.

The feed system for an energy-efficient, central and even supply of the feed material 5 into the grinding chamber 3 and onto the grinding track 26 of the grinding pan 4 comprises a screw feeder 10. The screw feeder 10 is arranged substantially horizontally and integrated into the roller mill 2 in the region of the grit cone 8.

The screw feeder 10 is connected outside of the roller mill 2 with a feed channel 18 which is arranged virtually perpendicular on the outer side on the roller mill 2 or on the classifier 7. In a connection region 23 between the screw feeder 10 and the feed channel 19, a compensator (not shown) can be arranged for vibration insulation of the feed system, in particular the screw feeder 10, from the roller mill 2.

The screw feeder 10 comprises a screw shaft 12 which is guided through the roller mill 2 or the grit cone 8 and thereby cuts the longitudinal axis 20 of the roller mill. In the region of the longitudinal axis 20 a conveyor tray 11 and a cover 21 of the screw feeder 10 end which can also be formed as a tubular screw conveyer.

It follows from the drawing that the screw feeder 10 is arranged with a mill outer side end region 25 outside of the roller mill 2 while a grinding chamber side end region 27 is arranged in the centre of the roller mill 2 or the grinding chamber 3.

The feeding of the feed material 5 out of the perpendicular feed channel 19 into the screw feeder 10 takes place via a receiving opening 15 in the mill outer side end region 25 in that the feed material 5 drops into the conveyor tray 11 and is forcibly conveyed with the aid of the screw drive 29 from the mill outer side end region 25 as far as the grinding chamber side end region 27 and an ejection opening 17 formed here. The forcible conveyance prevents deposit build-up and blockages.

The ejection opening 17 in the conveyor tray 11 is located above the cone opening 9 and is formed coaxially with the longitudinal axis 20 so that the feed material 5 together with the coarse grain passes via the cone opening 9 onto the central distribution region 24 of the grinding pan 4 and from here evenly onto the grinding track 26 for grinding.

The screw shaft 12 is provided outside of the conveyor tray 11 and the cover 21 or outside of the tubular screw conveyer with a protective pipe 16 which extends as far as close to a bearing 14 for the screw shaft 12. Seals (not shown) of the screw shaft 12 in relation to the fixed mill housing 22 can be provided.

A drive means 13 outside of the roller mill 2 is connected to the end region of the screw shaft lying opposite the bearing 14 and can, like the bearing 14, be arranged on a supporting construction 18 of the roller mill 2.

The invention claimed is:

1. Roller mill having a grinding chamber and a rotating grinding pan, on which resiliently impacted grinding rollers roll and grind feed material which is fed to the grinding pan with the aid of a feed system, having a classifier above the grinding chamber, to which the ground grinding material is fed in an ascending gas flow and having a grit cone for coarse grain rejected in the classifier and dropping down which passes via a conical opening back into the grinding chamber and to the grinding pan for renewed grinding, wherein the feed system comprises a screw feeder which is integrated in the region of the grit cone into the roller mill and is formed in such a way that the feed material is conveyed into the roller mill and centrally fed to the grinding pan, characterised in that the screw feeder comprises a screw shaft which cuts the longitudinal axis of the roller mill and is arranged on both sides respectively outside of the roller mill, the screw shaft is connected at one end with a drive means and is positioned at the other end in a bearing and the drive means and the bearing are arranged outside of the roller mill.

2. Roller mill according to claim 1, characterised in that the screw feeder is formed as a tubular screw conveyer and is arranged virtually horizontally and above the cone opening of the grit cone.

3. Roller mill according to claim 1, characterised in that the screw feeder comprises a mill outer side end region and a grinding chamber side end region and a receiving opening for the feed material is formed in the mill outer side end region and an ejection opening for the central feed of the feed material onto the grinding pan is formed in the grinding chamber side end region.

4. Roller mill according to claim 1, characterised in that the screw feeder comprises a conveyor tray and a cover which extend from the mill outer side end region to the grinding chamber side end region and the receiving opening is formed in the cover and the ejection opening in the pipe tray and virtually coaxially with the longitudinal axis of the roller mill and above the cone opening.

5. Roller mill according to claim 1, characterised in that the feed system comprises a feed channel for the feed material which is arranged virtually perpendicular on the side and outside of the roller mill and is connected to the screw feeder via the receiving opening in the mill outer side end region.

6. Roller mill according to claim 1, characterised in that a means for vibration insulation of the feed system from the roller mill is provided.

7. Roller mill according to claim 6, characterised in that the means for vibration insulation comprises a compensator which is integrated into the feed channel.

8. Roller mill according to claim 1, characterised in that a seal is provided between the rotating screw shaft and the mill housing which is formed as a mechanical seal or takes place by means of barrier gas.

9. Roller mill according to claim 1, characterised in that the drive means of the feed system is designed with a constant speed or with a speed which can be regulated by means of a frequency inverter.

10. Roller mill according to claim 1, characterised in that the grinding pan comprises a central distribution region for distributing the feed material and the returned coarse grain under the grinding rollers which is formed as a raised region, for example in the form of a truncated cone or as a dispersion plate, and the ejection opening of the screw feeder and the cone opening of the grit cone are arranged above the central distribution region of the grinding pan.

* * * * *